US005406972A

United States Patent [19]

Coscarella et al.

[11] Patent Number: 5,406,972

[45] Date of Patent: Apr. 18, 1995

[54] BACKWATER VALVE

[76] Inventors: Gabe Coscarella, 15703 - 64 Street, Edmonton, Alberta, Canada, T5Y 2N5; Vitto Chiodo, 6916 - 142 Avenue, Edmonton, Alberta, Canada, T5L 2P2

[21] Appl. No.: 257,914

[22] Filed: Jun. 10, 1994

[30] Foreign Application Priority Data

Jan. 31, 1994 [CA] Canada ..... 2114602

[51] Int. Cl.[6] ..... F16K 31/18; F16K 33/00; F16K 43/00

[52] U.S. Cl. ..... 137/315; 137/409; 137/418

[58] Field of Search ..... 137/242, 244, 305, 409, 137/448; 4/393, 394, 395, 441, 442, 669, 679, 687, 688; 405/96

[56] References Cited

U.S. PATENT DOCUMENTS

| | | | |
|---|---|---|---|
| 194,676 | 8/1877 | Hansen | 137/409 |
| 199,696 | 1/1878 | Dikeman | 137/448 |
| 289,108 | 11/1883 | Johnson | 137/409 |
| 1,205,199 | 11/1916 | Healy | 137/448 |
| 1,584,666 | 5/1926 | Shockley | 137/236.1 |
| 1,606,396 | 11/1926 | Blom | 137/409 |
| 1,861,397 | 3/1932 | Khun | 137/448 |
| 1,864,443 | 6/1932 | Khun | 137/448 |
| 1,924,498 | 8/1933 | House | 137/409 |
| 2,638,178 | 5/1953 | McRill | 137/409 |
| 2,695,072 | 11/1954 | Hauslein | 137/448 |
| 2,928,410 | 3/1960 | Vecchio | 137/448 |
| 3,176,707 | 4/1965 | Wilson | 137/448 |
| 3,626,521 | 12/1971 | Delco | 137/448 |
| 3,781,920 | 1/1974 | Browne et al. | 4/441 |
| 3,974,654 | 8/1976 | Mirto, Jr. | 137/409 |
| 4,324,506 | 4/1982 | Steinke | 405/96 |
| 4,503,881 | 3/1985 | Vecchio | 137/425 |
| 4,787,103 | 11/1988 | Endo | 4/441 |
| 5,234,018 | 8/1993 | Grachal et al. | 137/244 |

*Primary Examiner*—George L. Walton
*Attorney, Agent, or Firm*—Anthony R. Lambert

[57] ABSTRACT

A backwater valve is described which includes a liquid retaining body having a top, a bottom, a first end, a second end, opposed sides and an inner chamber. A first flow conduit extends through one of the top of the body and the first end adjacent the top of the body and protrudes into the inner chamber. A second flow conduit extends from the inner chamber through the second end adjacent the bottom of the body and protrudes past the second end. An annular seal is positioned on an annular peripheral edge of the first flow conduit which protrudes into the inner chamber. A plate is pivotally mounted to the body. The plate having a wear resistant lubricious first face, a second face, a first end and a second end. The first end underlies the first flow conduit. The first face extends past the first flow conduit thereby serving as a spillway for liquids flowing through the first flow conduit. The plate is pivotally movable between a closed position and an open position. In the open position the first face engages the annular seal. In the open position the first face is spaced from the annular seal. The plate is maintained in a normally open position by force of gravity. A float is secured to the second face of the plate such that the plate floats into the closed position when the inner chamber is filled with liquid.

9 Claims, 4 Drawing Sheets

FIGURE 1

BACKWATER VALVE

The present invention relates to a backwater valve.

BACKGROUND OF THE INVENTION

Backwater valves are installed in liquid flow lines to prevent a reversing of the flow. One example of a flow line in which a backwater valve would be used is in a building sewer line going from a private residence to a main sewer line. The backwater valve prevents raw sewage from flowing back into the private residence should the main sewer line overflow.

An example of a backwater valve is U.S. Pat. No. 1,606,396 which issued to Blom in 1926. The Blom reference discloses an upper horizontal section of pipe with a downwardly turned elbow and a lower horizontal section of pipe with an upwardly turned elbow. The downwardly turned elbow and the upwardly turned elbow are connected with a horizontal annular valve seat positioned therebetween. A normally pendant float valve is suspended from the valve seat. When water rises in the lower horizontal section of pipe the float valve floats into engagement with the annular valve seat to restrict the flow.

There are number of disadvantages with backwater valves constructed in accordance with the teachings of Blom. The float valve is subject to a build up of hair, toilet paper and other debris. This debris prevents the float valve from fully closing. If the float valve does not fully close the valve merely serves to restrict rather than eliminate the backflow and raw sewage will seep into the residence. Blow recognized this potential problem in the design and provided for both a cover secured by bolts above the valve seat and a plug provided near the hinge of the float valve to allow access for cleaning purposes. The backwater valves are underground installations which are difficult to access for the purpose of maintenance, so as a practical matter it would not be discovered that the valve was in need of cleaning until it failed to work.

In order to address these problems axial flow backwater valve mechanisms have been developed that have indirect valve closure mechanisms. An example is U.S. Pat. No. 4,503,881 which has a gate pivoted from above. The gate is attached to a float mechanism in an antechamber. Liquid entering the antechamber causes the float mechanism to rise. As the float mechanism rises the gate is closed. Backwater valves with indirect closure mechanisms are more complex and as a consequence are more expensive.

SUMMARY OF THE INVENTION

What is required is a backwater valve that is less prone to blockages and which has a simple direct closure mechanism.

According to the present invention there is provided a backwater valve which includes a liquid retaining body having a top, a bottom, a first end, a second end, opposed sides and an inner chamber. A first flow conduit extends through one of the top of the body and the first end adjacent the top of the body and protrudes into the inner chamber. A second flow conduit extends from the inner chamber through the second end adjacent the bottom of the body and protrudes past the second end. An annular seal is positioned on an annular peripheral edge of the first flow conduit which protrudes into the inner chamber. A plate is pivotally mounted to the body. The plate having a wear resistant lubricious first face, a second face, a first end and a second end. The first end underlies the first flow conduit. The first face extends past the first flow conduit thereby serving as a spillway for liquids flowing through the first flow conduit. The plate is pivotally movable between a closed position and an open position. In the open position the first face engages the annular seal. In the open position the first face is spaced from the annular seal. The plate is maintained in a normally open position by force of gravity. A float is secured to the second face of the plate such that the plate floats into the closed position when the inner chamber is filled with liquid.

The invention, as described above, addresses the problem of blockages in a number of ways. The lubricious first face of the plate is smooth and slippery so that any hair, toilet paper and other debris simply washes over the first face and will not wrap around the plate. The first end of the plate underlies the first flow conduit so that hair, toilet paper and other debris must fall upon first face and cannot fall behind or underneath the plate. The teachings of the Blom are difficult to adapt to an axial flow. it is difficult to fit an upper horizontal section of pipe with a downwardly turned elbow and a lower horizontal section of pipe with an upwardly turned elbow into an existing axial flow branch sewer line. Conversely, the teachings of U.S. Pat. No. 4,503,881 are difficult to adapt to a flow which goes from vertical to horizontal. The teachings of the present invention are readily adaptable to both types of flow.

Although beneficial results may be obtained through the use of the invention, as described above, the greater control over the flow through the first flow conduit, the less the possibility that a blockage will result. Even more beneficial results may, therefore, be obtained when the first face of the plate has sidewalls such that the first face forms a channel.

Although beneficial results may be obtained through the use of the backwater valve, as described above, it is preferable that the plate does not rest on the bottom of the inner chamber where it may become soiled by debris which adversely effects its operation by causing the plate to adhere to the bottom of the inner chamber. Even more beneficial results may, therefore, be obtained when stop means are provided to limit the positioning of the plate in the open position. It is preferred that the first end of the plate engaging the first flow conduit serve as stop means.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
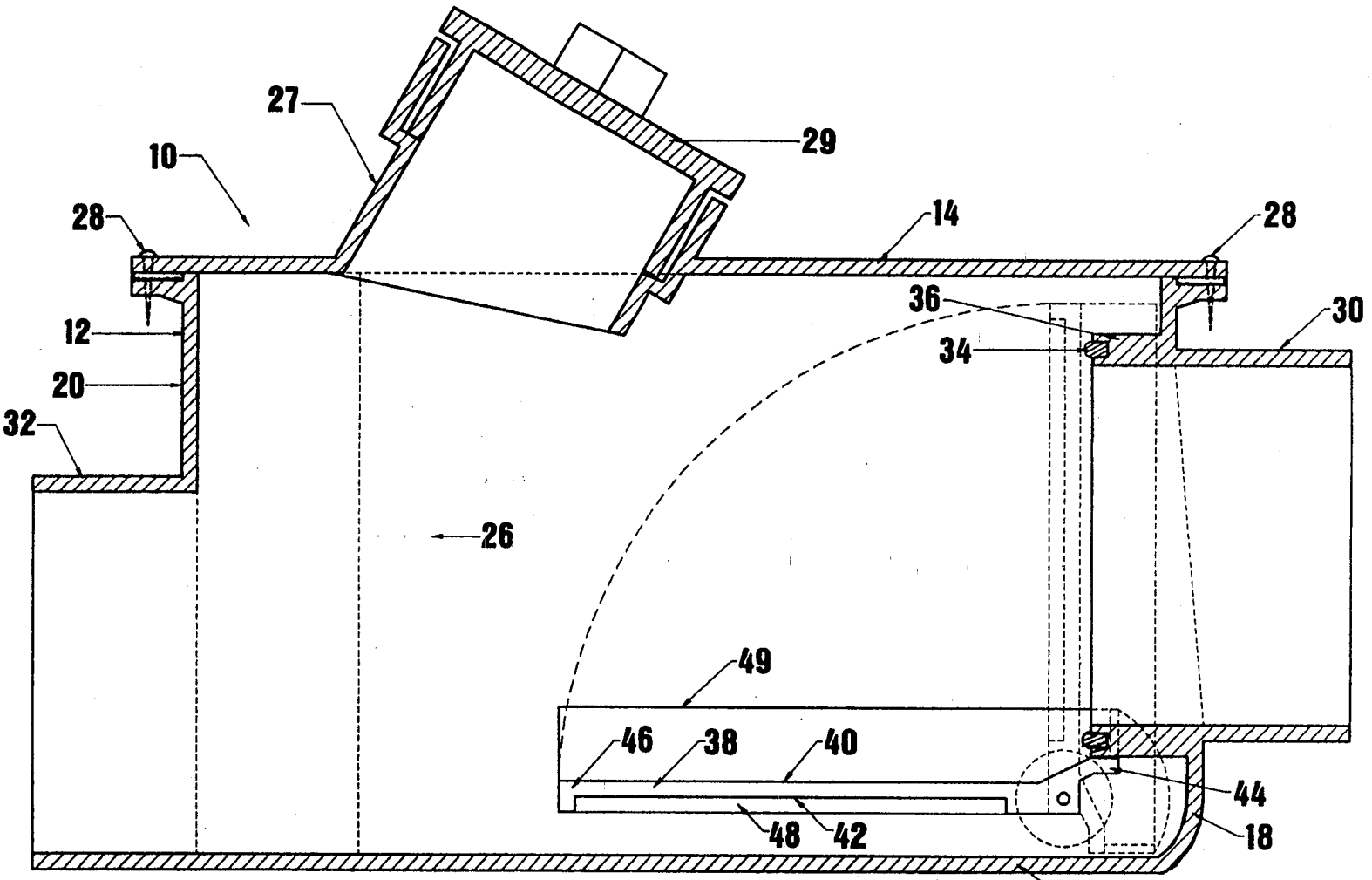
FIG. 1 is a side elevation view in longitudinal section of an axial flow backwater valve constructed in accordance with the teachings of the present invention.

The preferred embodiments, backwater valves generally identified by reference numeral 10 and 11, will now be described with reference to FIGS. 1 through 4.

Figure 2:
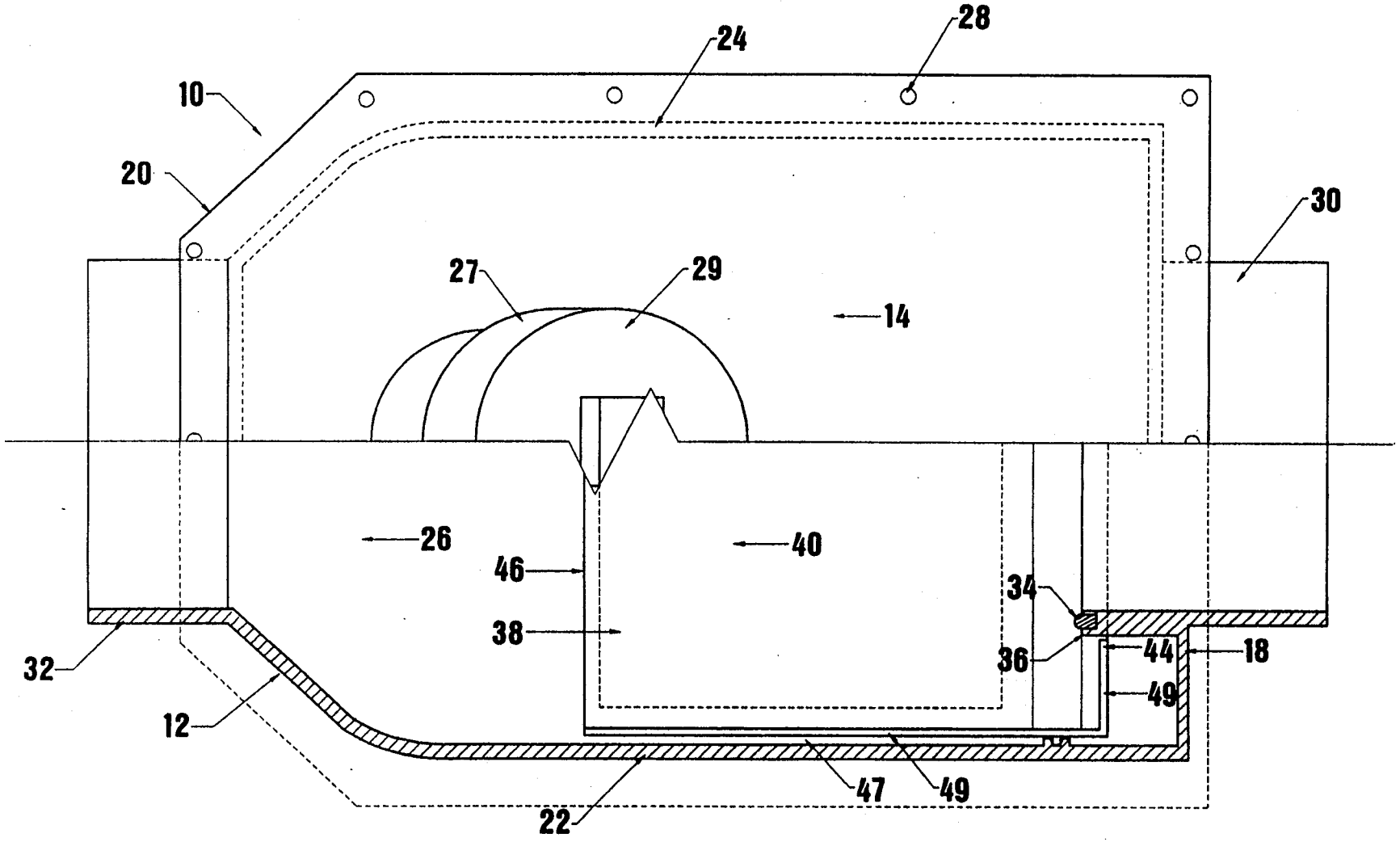
FIG. 2 is a partially cut away top plan view of the axial flow backwater valve illustrated in FIG. 1.

The first embodiment illustrated in FIGS. 1 and 2 is an axial flow backwater valve, generally identified by reference numeral 10. Axial flow backwater valve 10 has a liquid retaining body 12 having a top 14, a bottom 16, a first end 18, a second end 20, opposed sides 22 and 24. Body 12 has an inner chamber 26. Top 14 of body 12 is secured by removable fasteners 28 and as such is removable to provide access to inner chamber 26 for purposes of routine maintenance and servicing. In addition, a clean out passage 27 with a removable closure 29 is provided through top 14. A first flow conduit 30 extends through first end 18 adjacent top 14 of body 12 and protrudes into inner chamber 26. A second flow conduit 32 extends from inner chamber 26 through second end 20 adjacent bottom 16 of body 12 and protrudes past second end 20. An annular seal 34 is positioned on an annular peripheral edge 36 of first flow conduit 30 which protrudes into inner chamber 26. A plate 38 is pivotally mounted to body 12. Plate 38 has a wear resistant lubricious first face 40, a second face 42, a first end 44, a second end 46, and opposed sides 47. Opposed sides 47 are positioned in close proximity to opposed sides 22 and 24. This prevents hair, toilet paper and other debris from getting between sides 47 of plate 38 and sides 22 and 24 of body 12. First end 44 underlies first flow conduit 30. First face 40 extends past first flow conduit 30 and serves as a spillway for liquid flowing through first flow conduit 30. First face 40 of plate 38 has sidewalls 49 which extend along opposed sides 47 and a portion of first end 44 to turn first face 40 into a flow channel. Referring to FIG. 1, plate 38 is pivotally movable between a closed position and an open position. In the closed position first face 40 engages annular seal 34 to prevent a reversal of the liquid flow. In the open position first face 40 is spaced from annular seal 34 with first end 44 plate 38 engaging first flow conduit 30. This serves as stop means for plate 38 in the open position placing first face 40 of plate 38 in a substantially horizontal position. Plate 38 is maintained in the open position by force of gravity. A styrofoam float 48 is secured to second face 42 of plate 38 such that plate 38 floats into the closed position as inner chamber 26 fills with liquid.

Figure 3:
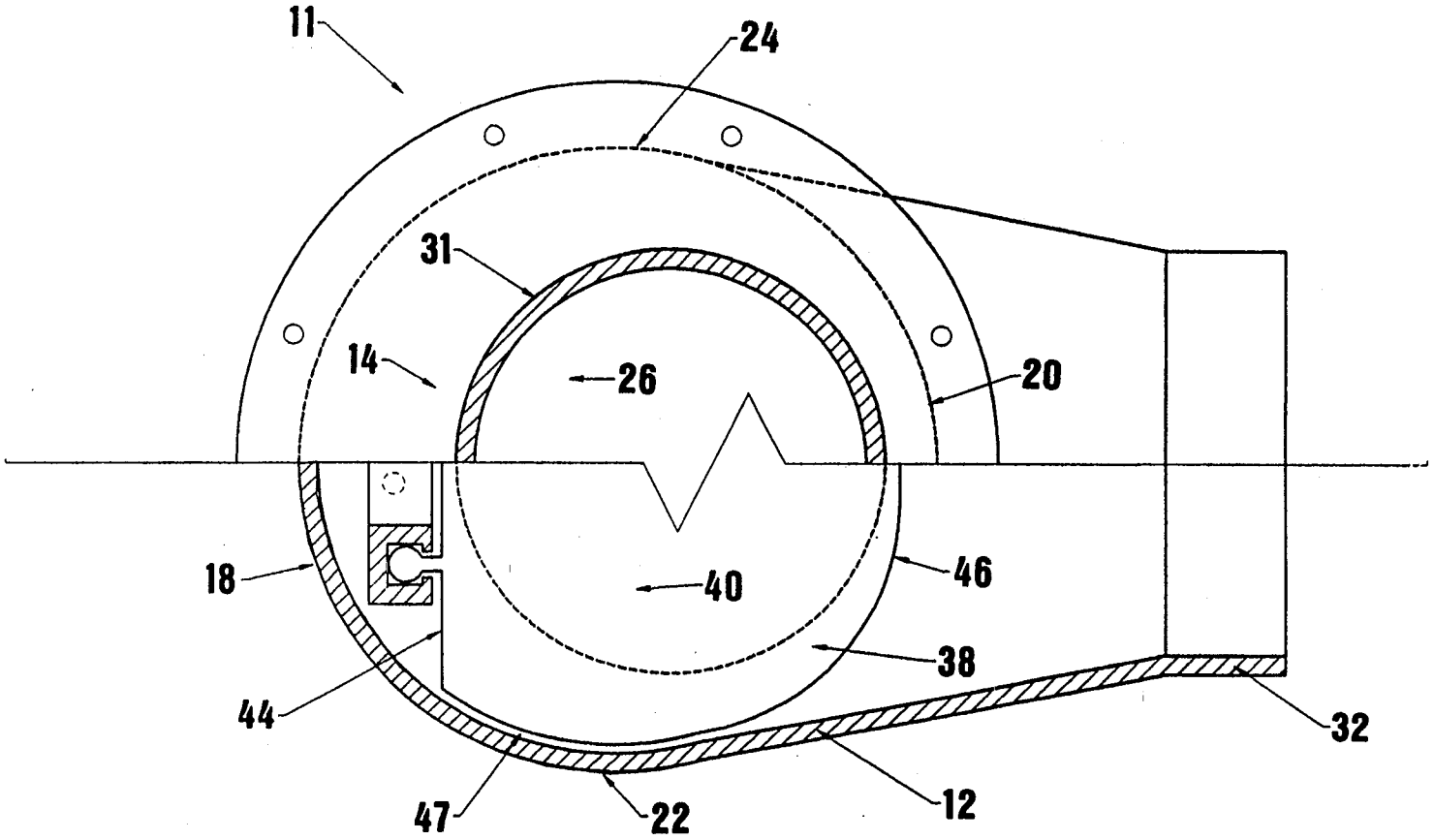
FIG. 3 is a partially cut away top plan of an angular flow backwater valve constructed in accordance with the teachings of the present invention.
Figure 4:
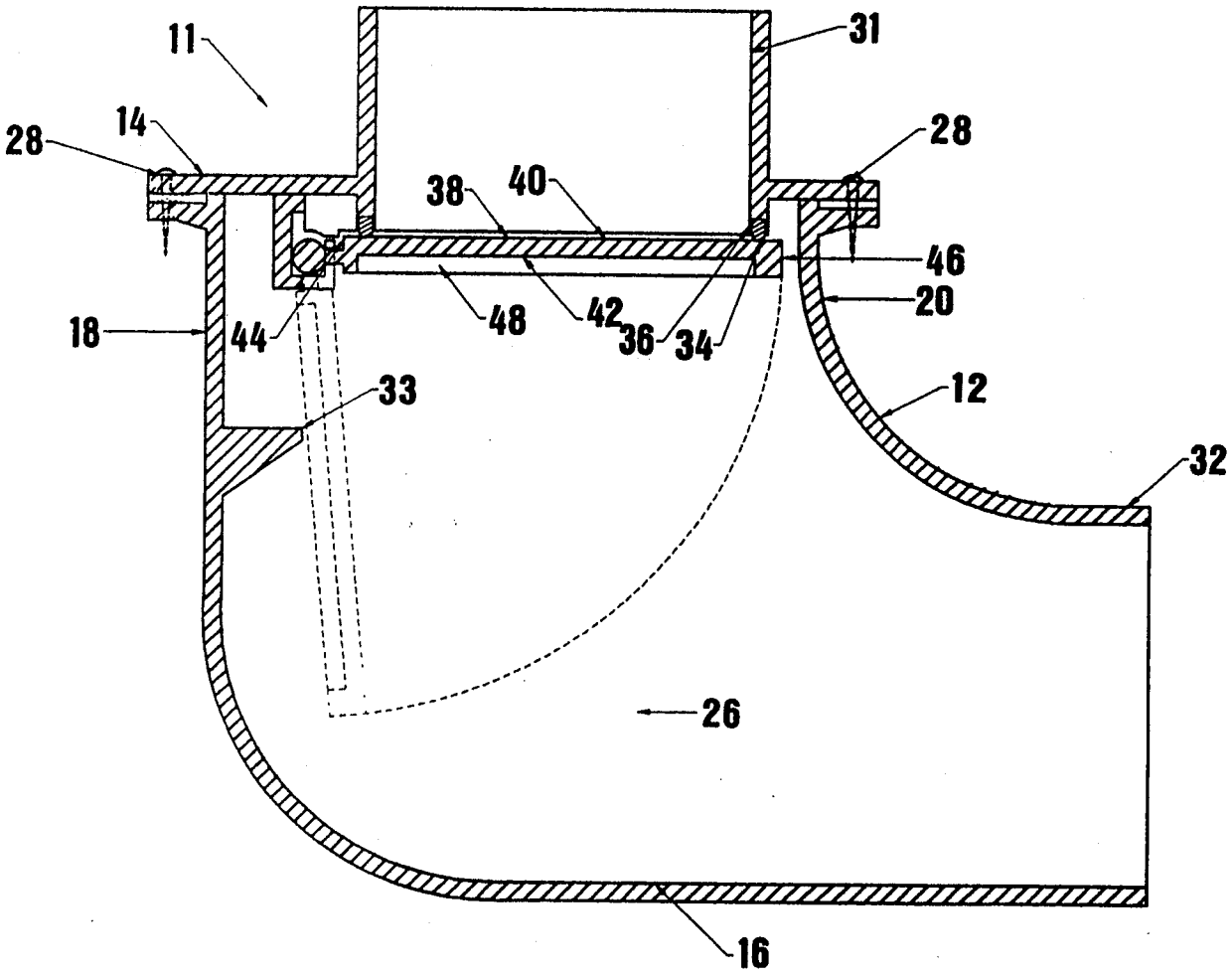
FIG. 4 is a side elevation view in longitudinal section of the axial flow backwater valve illustrated in FIG. 3.

The second embodiment illustrated in FIGS. 3 and 4 is an angular flow backwater valve, generally identified by reference numeral 11. Angular flow backwater valve is similar in structure, and in the description which follows like components will be identified by the same reference numerals by which they were identified in the description of axial flow backwater valve 10. Angular flow backwater valve 11 includes a liquid retaining body 12 having a top 14, a bottom 16, a first end 18, a second end 20, opposed sides 22 and 24. Body 12 has an inner chamber 26. Top 14 of body 12 is secured by removable fasteners 28 and as such is removable to provide access to inner chamber 26 for purposes of routine maintenance and servicing. A first flow conduit 31 extends through top 14 of body 12 and protrudes into inner chamber 26. A second flow conduit 32 extends from inner chamber 26 through second end 20 adjacent bottom 16 of body 12 and protrudes past second end 20. An annular seal 34 is positioned on an annular peripheral edge 36 of first flow conduit 31 which protrudes into inner chamber 26. A plate 38 is pivotally mounted to top 14 of body 12. When top 14 is removed for servicing, plate 38 comes with it. Plate 38 has a wear resistant lubricious first face 40, a second face 42, a first end 44, a second end 46, and sides 47. First end 44 underlies first flow conduit 30. First face 40 extends past first flow conduit 30 and serves as a spillway for liquid flowing through first flow conduit 30. Sides 47 are positioned in close proximity to and match the contour of opposed sides 22 and 24. This prevents hair, toilet paper and other debris from getting between sides 47 of plate 38 and sides 22 and 24 of body 12. Referring to FIG. 4, plate 38 is pivotally movable between a closed position and an open position. In the closed position first face 40 engages annular seal 34 to prevent a reversal of the liquid flow. In the open position first face 40 is spaced from annular seal 34 with second face 42 of plate 38 engaging a stop 33 which protrudes from first end 18 of body 12. This serves to position plate 38 at an angle with second end 46 of plate 38 angled toward the flow path of first flow conduit 31. Plate 38 is maintained in the open position by force of gravity. A styrofoam float 48 is secured to second face 42 of plate 38 such that plate 38 floats into the closed position as inner chamber 26 fills with liquid.

It is necessary that first face 40 be made of a lubricious material in order to ensure that its surface will shed hair, toilet paper and other debris. Materials found to be suitable are polymer plastics used in constructing pipes, such as PVC plastic and ABS plastic.

It will be apparent to one skilled in the art that modifications may be made to the illustrated embodiments without departing from the spirit and the scope of the invention as hereinafter defined in the Claims. In particular, there are various alternative floats that could be used in place of styrofoam float 48. For example, plate 38 could be constructed out of inherently buoyant materials or with an underlying air pocket.

The embodiments of the invention in which an exclusive property or privilege is claimed are defined as follows:

1. A backwater valve, comprising:

(a) a liquid retaining body having a top, a bottom, a first end, a second end, opposed sides and an inner chamber;

(b) a first flow conduit extending through one of the top of the body and the first end adjacent the top of the body and protruding into the inner chamber;

(c) a second flow conduit extending from the inner chamber through the second end adjacent the bottom of the body and protruding past the second end;

(d) an annular seal on an annular peripheral edge of the first flow conduit protruding into the inner chamber;

(e) a plate pivotally mounted to the body, the plate having a wear resistant lubricious first face, a second face, a first end and a second end, the first end underlying the first flow conduit, the first face extending past the annular peripheral edge of the first flow conduit and surrounding at least a portion of the conduit thereby serving as a spillway, the plate being pivotally movable between a closed position in which the first face engages the annular seal and an open position in which the first face is spaced from the annular seal, the spillway thereby preventing fluid overflow and accumulation of debris between the bottom of the liquid retaining body and the plate as the plate moves from a closed position to an open position; and (f) the plate being maintained in a normally open position by force of gravity, a float being secured to the second face of the plate such that the plate floats into the closed position when the inner chamber is filled with liquid.

2. The backwater valve as defined in claim 1, wherein the plate has opposed sides in close proximity to the opposed sides of the body thereby preventing hair, toilet paper and other debris from passing between the sides of the plate and sides of the body.

3. The backwater valve as defined in claim 1, wherein the first face of the plate has sidewalls such that the first face forms a channel.

4. The backwater valve as defined in claim 1, wherein stop means is provided to limit the positioning of the plate in the open position.

5. The backwater valve as defined in claim 4, wherein the first end of the plate engaging the first flow conduit serves as stop means.

6. The backwater valve as defined in claim 1, the top of the body being removable thereby providing access to the inner chamber for purposes of servicing.

7. The backwater valve as defined in claim 1, the body having a clean out passage with a removable closure.

8. A backwater valve, comprising:

(a) a liquid retaining body having a top, a bottom, a first end, a second end, opposed sides and an inner chamber, the top of the body being removable thereby providing access to the inner chamber for purposes of servicing;

(b) a first flow conduit extending through the top of the body and protruding into the inner chamber;

(c) a second flow conduit extending from the inner chamber through the second end adjacent the bottom of the body and protruding past the second end;

(d) an annular seal on an annular peripheral edge of the first flow conduit protruding into the inner chamber;

(e) a plate pivotally mounted to the body, the plate having a wear resistant lubricious first face, a second face, a first end, a second end, and opposed sides, the first end underlying the first flow conduit with the opposed sides surrounding at least a portion of the conduit, the first face extending past the annular peripheral edge of the first flow conduit thereby serving as a spillway, the plate being pivotally movable between a closed position in which the first face engages the annular seal and an open position in which the first face is spaced from the annular sea, the plate being maintained in a normally open position by force of gravity, the spillway thereby preventing fluid overflow and accumulation of debris between the bottom of the liquid retaining body and the plate as the plate moves from a closed position to an open position; and (f) a float being secured to the second face of the plate such that the plate floats into the closed position when the inner chamber is filled with liquid, the opposed sides of the plate being in close proximity to the opposed sides of the body thereby preventing hair, toilet paper and other debris from passing between the sides of the plate and sides of the body.

9. A backwater valve, comprising:

(a) a liquid retaining body having a top, a bottom, a first end, a second end, opposed sides and an inner chamber, the top of the body being removable thereby providing access to the inner chamber for purposes of servicing;

(b) a first flow conduit extending through the first end adjacent the top of the body and protruding into the inner chamber;

(c) a second flow conduit extending from the inner chamber through the second end adjacent the bottom of the body and protruding past the second end;

(d) an annular seal on an annular peripheral edge of the first flow conduit protruding into the inner chamber;

(e) a plate pivotally mounted to the body, the plate having a wear resistant lubricious first face, a second face, a first end, a second end, and opposed sides, the first end underlying the first flow conduit, the first face extending past the annular peripheral edge of the first flow conduit and surrounding at least a portion of the conduit thereby serving as a spillway for liquid flowing through the first flow conduit, the opposed side of the first face of the plate forming sidewalls, the plate being pivotally movable between a closed position in which the first face engages the annular seal and an open position in which the first face is spaced from the annular seal, the plate being maintained in a normally open position by force of gravity, the spillway thereby preventing fluid overflow and accumulation of debris between the bottom of the liquid retaining body and the plate as the plate moves from a closed position to an open position; and (f) the first end of the plate engaging the first flow conduit to serve as stop means limiting the movement of the plate in the open position, a float being secured to the second face of the plate such that the plate floats into the closed position when the inner chamber is filled with liquid, the opposed sides of the plate being in close proximity to the opposed sides of the body thereby preventing hair, toilet paper and other debris from passing between the sides of the plate and sides of the body.

* * * * *